US007063278B2

(12) United States Patent
Stier et al.

(10) Patent No.: US 7,063,278 B2
(45) Date of Patent: Jun. 20, 2006

(54) FUEL INJECTION VALVE

(75) Inventors: Hubert Stier, Vaihingen/Enz (DE); Elmar Okrent, Remseck (DE); Ulrich Döbler, Remseck (DE)

(73) Assignee: Robert Bosch GmbH, Stuttgart (DE)

( * ) Notice: Subject to any disclaimer, the term of this patent is extended or adjusted under 35 U.S.C. 154(b) by 68 days.

(21) Appl. No.: 10/250,531

(22) PCT Filed: Aug. 23, 2002

(86) PCT No.: PCT/DE02/03093

§ 371 (c)(1),
(2), (4) Date: Jan. 6, 2004

(87) PCT Pub. No.: WO03/040545

PCT Pub. Date: May 15, 2003

(65) Prior Publication Data

US 2004/0094640 A1 May 20, 2004

(30) Foreign Application Priority Data

Oct. 31, 2001 (DE) ..... 101 53 630

(51) Int. Cl.
*F02M 59/00* (2006.01)
*F02M 47/02* (2006.01)
*B05B 1/30* (2006.01)

(52) U.S. Cl. ..... 239/533.2; 239/88; 239/585.1; 239/585.3; 239/585.5; 239/584

(58) Field of Classification Search ..... 239/533.2, 239/533.1, 585.1–585.5, 88–93, 584, 900; 251/129.15, 129.21, 127
See application file for complete search history.

(56) References Cited

U.S. PATENT DOCUMENTS 4,814,659 A * 3/1989 Sawada ..... 310/328
5,692,723 A * 12/1997 Baxter et al. ..... 251/129.21
6,637,677 B1 * 10/2003 Ruehle et al. ..... 239/584

FOREIGN PATENT DOCUMENTS

| | | |
|---|---|---|
| DE | 195 34 445 | 3/1997 |
| DE | 199 21 489 | 11/2000 |
| DE | 199 28 204 | 12/2000 |
| DE | 199 43 142 | 4/2001 |
| EP | 0 869 278 | 10/1998 |

* cited by examiner

*Primary Examiner*—Davis Hwu
(74) *Attorney, Agent, or Firm*—Kenyon & Kenyon LLP

(57) ABSTRACT

A fuel injector (1) for the direct injection of fuel into the combustion chamber of an internal combustion engine has a piezoelectric actuator (2) which is encapsulated in an actuator housing (3); a valve needle (9) which is in operative connection with the actuator and on which a valve-closure member (11) is formed which forms a sealing seat together with a valve-seat surface (13); and a nozzle body (12) into which the actuator housing (3) is able to be inserted. The actuator housing (3) and the nozzle body (12) are sealed by a common connecting part (4), the connecting part (4) having a first and a second diameter step (19; 20).

13 Claims, 1 Drawing Sheet

FUEL INJECTION VALVE

FIELD OF THE INVENTION

The present invention is directed to a fuel injector.

BACKGROUND INFORMATION

For instance, from German Patent No. 195 34 445, a fuel injector is known which has an axially movable valve needle in a nozzle body. The valve needle is able to be actuated by a piezoelectric actuator and held in the closing position by a compression spring. The fuel is supplied by an external source at a freely adjustable pressure. The valve needle has a central bore. The piezoactuator concentrically surrounds the valve needle and is sealed from the fuel pressure by sealing surfaces.

Disadvantageous in the fuel injector known from German Patent No. 195 34 445 is, in particular, that the encapsulation of the piezoelectric actuator, which must be sealed from the corrosive fuel and the pressure of the fuel, is labor intensive and expensive. In addition, it is difficult to compensate for thermal longitudinal changes in the actuator in order to avoid subsequent malfunctions of the fuel injector.

SUMMARY OF THE INVENTION

In contrast, the fuel injector configured according to the present invention has the advantage over the related art that the piezoelectric or magnetostrictive actuator is situated in an actuator housing, and the nozzle body, in which the actuator housing is located, may be jointly sealed by a connecting part having graduated diameter steps that are able to be connected to the actuator housing and the nozzle body.

Furthermore, it is advantageous that the steps have different radial diameters, thereby setting the actuator housing and the nozzle body apart, so that the fuel may be conveyed to the sealing seat without bores in the housing.

The piezoelectric actuator is advantageously acted upon by a closing spring, which is situated between an end plate of the actuator and a shoulder of the actuator housing.

Moreover, it is advantageous that the connecting part can be produced in a simple and inexpensive manner by turning.

DETAILED DESCRIPTION

Figure 1:
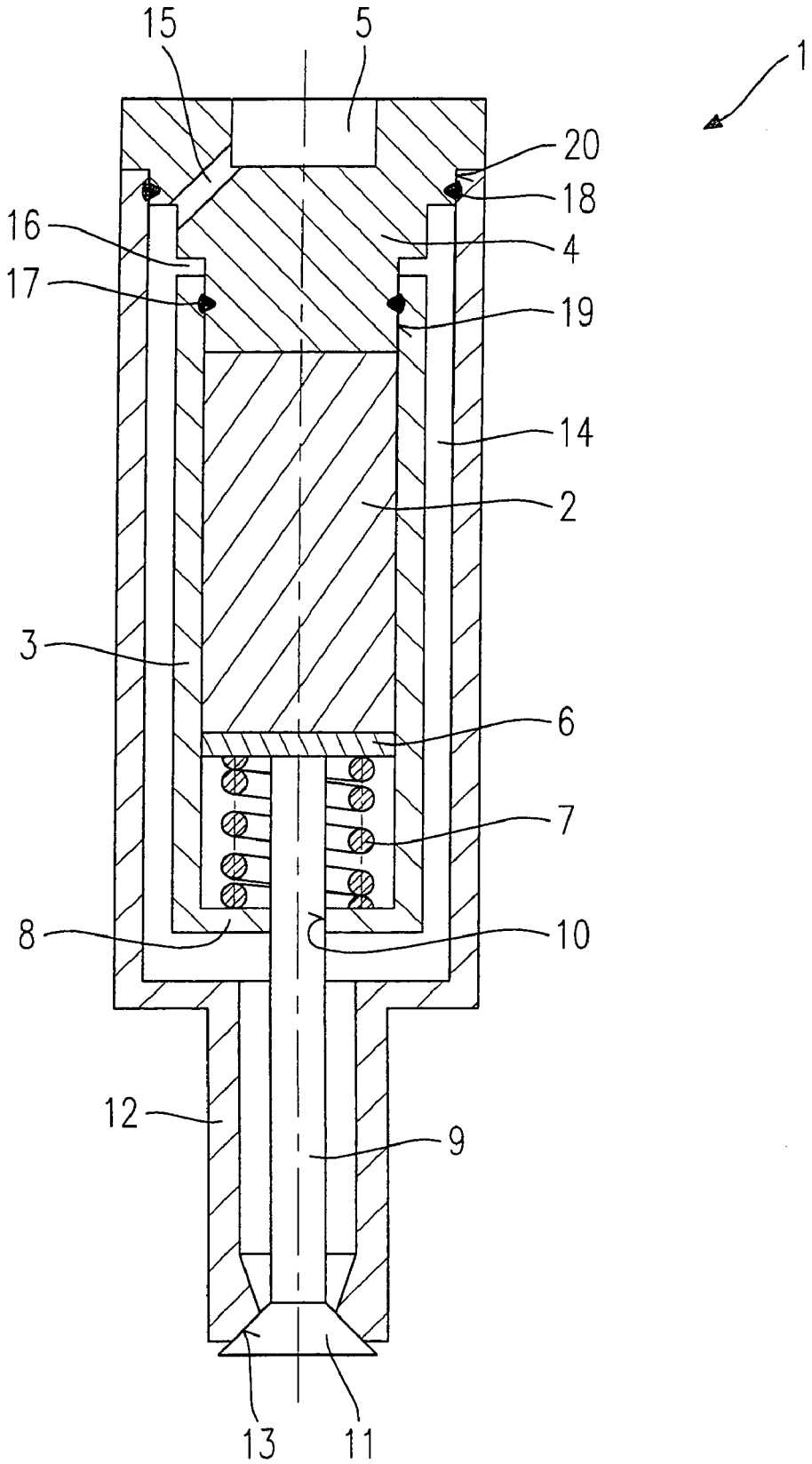
FIG. 1 shows a schematic section through an exemplary embodiment of a fuel injector configured according to the present invention.

An exemplary embodiment of a fuel injector 1 according to the present invention is designed in the form of a fuel injector 1 for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 includes a piezoelectric actuator 2 which is encapsulated in an actuator housing 3. On the inflow side, actuator housing 3 is sealed by a connecting part 4 which may be produced in a cost-effective manner by turning, for instance. Connecting part 4 has a fuel inflow 5 and an electrical connection (not shown further) for actuating piezoelectric actuator 2.

Piezoelectric actuator 2 is supported downstream on an end plate 6 at whose other side a closing spring 7 is positioned. Closing spring 7 is braced between end plate 6 and a shoulder 8 of actuator housing 3. It acts upon a valve needle 9, which is in force-locking connection to end plate 6, with a closing force that keeps fuel injector 1 closed in the de-energized state of piezoelectric actuator 2.

Valve needle 9 penetrates closing spring 7 and a recess 10 in shoulder 8 of actuator housing 3. At a downstream end of valve needle 9 is a valve-closure member 11 which forms a sealing seat together with a valve-seat surface 13 formed on a nozzle body 12. Inside nozzle body 12 is actuator housing 3, with connecting part 4 inserted therein on the inflow side. Nozzle body 12 is slipped onto connecting part 4 as well.

Connecting part 4 has a first diameter step 19 onto which actuator housing 3 is slipped, and a second diameter step 20 onto which nozzle body 12 is slipped. Due to the fact that the radial diameter of first diameter step 19 is smaller than that of second diameter step 20, an annular clearance space 14 is formed between actuator housing 3 and nozzle body 12, through which the fuel supplied via fuel supply 5 is guided to the sealing seat. At least one fuel channel 15 is formed in connecting part 4 for a connection between fuel supply 5 and clearance space 14.

The described encapsulation of piezoelectric actuator 2 in actuator housing 3 and the joint sealing of actuator housing 3 and nozzle body 12 by connecting part 4 is characterized, in particular, by its simple and cost-effective construction. The sealing may be implemented without additional elastomer seals. Connecting part 4 is able to be produced in a simple manner by turning and, in addition to fuel supply 5, may also accommodate the electrical line for exciting piezoelectric actuator 2, so that bores in the housing may be dispensed with. Waste heat generated during the operation of piezoelectric actuator 2, may also be carried away by the fuel flowing past actuator housing 3 and used, for instance, to preheat the fuel.

To adjust the spring force of closing spring 7, actuator housing 3 is slipped over connecting part 4 until the point is reached where the required spring force is attained, adjusting gap 16 being set in the process. Subsequently, actuator housing 3 is joined to connecting part 4, for instance, by a welding seam 17. Nozzle body 12 is also connected to connecting part 4, for instance, also by a welding seam 18.

In response to piezoelectric actuator 2 being energized by an electric voltage able to be externally supplied, it expands in a discharge direction of the fuel, counter to the spring force of closing spring 7. This moves end plate 6 with valve needle 9, which is in operative connection therewith, in the discharge direction as well. Valve-closure member 11, which is connected to valve needle 9 by force-locking, lifts off from valve-sealing seat 13, thereby spray-discharging fuel into the combustion chamber (not shown further) of an internal combustion engine.

If the voltage energizing piezoelectric actuator 2 is switched off, actuator 2 contracts. End plate 6 is relieved of pressure, and the force of closing spring 7 presses it counter to the discharge direction of the fuel. Valve needle 9, which is in force-locking connection to end plate 6, also moves counter to the discharge direction, so that valve-closure member 11 sets down on valve-seat surface 13 and fuel injector 1 is closed.

The present invention is not limited to the exemplary embodiment shown and is also suitable, for instance, for fuel injectors 1 having magnetostrictive actuators or also to inwardly opening fuel injectors 1.

What is claimed is:

1. A fuel injector for a direct injection of a fuel into a combustion engine, comprising:

an actuator housing;

one of a piezoelectric actuator and a magnetostrictive actuator encapsulated in the actuator housing;

a valve needle that is in operative connection with the one of the piezoelectric actuator and the magnetostrictive actuator;

a valve-seat surface;

a nozzle body into which is inserted the actuator housing; and a joint connecting part having graduated diameter steps and by which the actuator housing and the nozzle body are sealed on an inflow side, wherein:

the joint connecting part includes a first diameter step that is connected to the actuator housing, and the joint connecting part includes a second diameter step that is connected to the nozzle body.

2. The fuel injector as recited in claim 1, wherein:

the actuator housing is joined to the joint connecting part via a welding seam.

3. The fuel injector as recited in claim 1, wherein:

the nozzle body is joined to the joint connecting part via a welding seam.

4. The fuel injector as recited in clam 1, wherein:

the joint connecting part is produced by turning.

5. A fuel injector for a direct injection of a fuel into a combustion engine, comprising:

an actuator housing;

one of a piezoelectric actuator and a magnetostrictive actuator encapsulated in the actuator housing;

a valve needle that is in operative connection with the one of the piezoelectric actuator and the magnetostrictive actuator;

a valve-seat surface;

a nozzle body into which is inserted the actuator housing; and a joint connecting part having graduated diameter steps and by which the actuator housing and the nozzle body are sealed on an inflow side, wherein:

the joint connecting part includes a first diameter step that is connected to the actuator housing, the joint connecting part includes a second diameter step that is connected to the nozzle body, and the actuator housing is slipped over the first diameter step.

6. A fuel injector for a direct injection of a fuel into a combustion engine, comprising:

an actuator housing;

one of a piezoelectric actuator and a magnetostrictive actuator encapsulated in the actuator housing;

a valve needle that is in operative connection with the one of the piezoelectric actuator and the magnetostrictive actuator;

a valve-seat surface;

a nozzle body into which is inserted the actuator housing; and a joint connecting part by which the actuator housing and the nozzle body are sealed, wherein:

the joint connecting part includes a first diameter step that is connected to the actuator housing, the joint connecting part includes a second diameter step that is connected to the nozzle body, and the nozzle body is slipped over the second diameter step.

7. A fuel injector for a direct injection of a fuel into a combustion engine, comprising:

an actuator housing;

one of a piezoelectric actuator and a magnetostrictive actuator encapsulated in the actuator housing;

a valve needle that is in operative connection with the one of the piezoelectric actuator and the magnetostrictive actuator;

a valve-seat surface;

a nozzle body into which is inserted the actuator housing; and a joint connecting part by which the actuator housing and the nozzle body are sealed, wherein:

the joint connecting part includes a first diameter step that is connected to the actuator housing, the joint connecting part includes a second diameter step that is connected to the nozzle body, and the second diameter step has a larger diameter than that of the first diameter step.

8. The fuel injector as recited in claim 7, wherein:

between the nozzle body and the actuator housing, an annular clearance space is formed in order to supply the fuel to the sealing seat.

9. The fuel injector as recited in claim 8, wherein:

the joint connecting part includes a fuel supply that is connected to the clearance space via a fuel channel.

10. A fuel injector for a direct injection of a fuel into a combustion engine, comprising:

an actuator housing;

one of a piezoelectric actuator and a magnetostrictive actuator encapsulated in the actuator housing;

a valve needle that is in operative connection with the one of the piezoelectric actuator and the magnetostrictive actuator;

a valve-seat surface;

a nozzle body into which is inserted the actuator housing; and a joint connecting part by which the actuator housing and the nozzle body are sealed, wherein:

the joint connecting part includes a first diameter step that is connected to the actuator housing, the joint connecting part includes a second diameter step that is connected to the nozzle body, and on an inflow side, the one of the piezoelectric actuator and the magnetostrictive actuator is braced on the joint connecting part.

11. A fuel injector for a direct injection of a fuel into a combustion engine, comprising:

an end plate, an actuator housing;

one of a piezoelectric actuator and a magnetostrictive actuator encapsulated in the actuator housing;

a valve needle that is in operative connection with the one of the piezoelectric actuator and the magnetostrictive actuator;

a valve-seat surface;

a nozzle body into which is inserted the actuator housing; and a joint connecting part by which the actuator housing and the nozzle body are sealed, wherein:

the joint connecting part includes a first diameter step that is connected to the actuator housing, the joint connecting part includes a second diameter step that is connected to the nozzle body, and on a discharge side, the one of the piezoelectric actuator and the magnetostrictive actuator is braced on the end plate.

12. The fuel injector as recited in claim 11, wherein:

the end plate is in a force-locking connection to the valve needle.

13. The fuel injector as recited in claim 11, further comprising:

a closing spring situated between the end plate and a shoulder of the actuator housing.

* * * * *